US011031705B2

(12) United States Patent
Penner et al.

(10) Patent No.: US 11,031,705 B2
(45) Date of Patent: Jun. 8, 2021

(54) ELECTRONIC DEVICE HOUSING INCORPORATING A CABLE CONNECTING DEVICE

(71) Applicant: Phoenix Contact GmbH & Co. KG, Blomberg (DE)

(72) Inventors: Eugen Penner, Stadtoldendorf (DE); Armin Struckmeier, Paderborn (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/759,749

(22) PCT Filed: Nov. 13, 2018

(86) PCT No.: PCT/EP2018/081033
§ 371 (c)(1),
(2) Date: Apr. 28, 2020

(87) PCT Pub. No.: WO2019/096768
PCT Pub. Date: May 23, 2019

(65) Prior Publication Data

US 2020/0381847 A1 Dec. 3, 2020

(30) Foreign Application Priority Data

Nov. 16, 2017 (BE) ..... 2017/5842

(51) Int. Cl.
*H01R 4/50* (2006.01)
*H01R 4/48* (2006.01)

(52) U.S. Cl.
CPC ..... *H01R 4/5066* (2013.01); *H01R 4/4818* (2013.01)

(58) Field of Classification Search
CPC ..... H01R 4/5066; H01R 4/4818; H01R 4/28; H01R 4/4836; H01R 3/08; H01H 85/20
See application file for complete search history.

(56) References Cited

U.S. PATENT DOCUMENTS 4,648,674 A * 3/1987 Sanchez, Jr. ..... H01H 85/201 439/395
5,586,903 A 12/1996 Hoffmann
2011/0318975 A1 12/2011 Giefers et al.

FOREIGN PATENT DOCUMENTS

DE 4414348 A1 10/1995
DE 19613557 A1 6/1997
(Continued)

*Primary Examiner* — Vanessa Girardi
(74) *Attorney, Agent, or Firm* — Leydig, Voit & Mayer, Ltd.

(57) ABSTRACT

The invention relates to an electronic device (2) comprising a housing body (4) for housing components, a connector (6) which has a receiving space (8) for a shield conductor section (10) and a housing cover (22) which is movable between a starting position and an end position for covering a portion (24) of the housing body. In this case the connector (6) has at least one cover (20), which is arranged movably on the housing body (4) between an open position and a closed position, in which the cover closes the opening (18). Furthermore, locking means (36) are provided with at least one locking member (38) which is movable between a locking position and an unlocking position, in which the locking member unlocks the cover (20) for a movement. The locking means (36) have at least one locking element (54) which is movable between a locking position, in which the locking element blocks a movement of the locking member (38) from a locking position into an unlocking position, and an unlocking position, in which a movement of the locking member (38) between a locking position and an unlocking position is allowed.

17 Claims, 8 Drawing Sheets

(56) References Cited

FOREIGN PATENT DOCUMENTS

| | | | |
|---|---|---|---|
| DE | 19743353 | A1 | 9/1998 |
| EP | 1722445 | A1 | 11/2006 |
| WO | WO 2010066399 | A1 | 6/2010 |
| WO | WO 2015040152 | A1 | 3/2015 |

* cited by examiner

ELECTRONIC DEVICE HOUSING INCORPORATING A CABLE CONNECTING DEVICE

CROSS-REFERENCE TO PRIOR APPLICATIONS

This application is a U.S. National Phase application under 35 U.S.C. § 371 of International Application No. PCT/EP2018/081033, filed on Nov. 13, 2018, and claims benefit to Belgian Patent Application No. BE 2017/5842, filed on Nov. 16, 2017. The International Application was published in German on May 23, 2019 as WO 2019/096768 under PCT Article 21(2).

FIELD

The invention relates to an electronic device comprising a housing body for housing components in order to receive and appropriately house electrical components in the housing body.

BACKGROUND

Electronic devices of the type in question are equipped with a connecting device, which is used to electrically connect a shield conductor to at least one electrical component, in particular a printed circuit board, which is received in the electronics housing at least in sections. For this purpose, a shield conductor section is inserted via an opening into the receiving space of the connecting device, in order to electrically contact the shield conductor section by means of contacting means. For this purpose, the shield conductor section is preferably uninsulated. The aforementioned connecting device is a shield conductor connecting device, which is also shortened and referred to below as a connecting device.

Electronic devices of the type in question are furthermore equipped with a housing cover movable between a starting position and an end position for covering a housing body section. In the end position, the housing cover covers the housing section at least in sections. In the starting position, the housing cover opens the housing body section and makes it accessible in order to be able to reach the interfaces found thereunder along with connection points, for example.

The housing cover thus serves, for example, to cover interfaces or connection points which are arranged on the housing body section and to protect against any external influences, for example unwanted touch or contacts. The aforementioned interfaces may, for example, be conductor/network connections or display elements. Such electronic devices are used to, among other things, provide connections for inputting electrical currents or signals, which the electronic device processes, for example modifies, measures, checks, converts, and finally outputs and/or provides for further use via output interfaces.

Connecting devices for electronic devices are known, for example, from DE 197 43 353 A1 and have a receiving space for a shield conductor, wherein an opening is provided for inserting the shield conductor into the receiving space, via which opening the shield conductor is inserted into the receiving space or removable therefrom.

The aforementioned contacting means for electrically contacting the shield conductor can be designed in different ways and may, for example, comprise, according to DE 10

2008 025 428 A1, a clamping screw which contacts the shield conductor in a clamping manner and thereby holds it in the receiving space.

SUMMARY

In an embodiment, the present invention provides an electronic device, comprising: a housing body for housing components, comprising a connecting device which has a receiving space for a shield conductor section; and a housing cover movable between a starting position and an end position for covering a housing body section, wherein the connecting device has at least one cover which is configured so as to be movably arranged on the housing body between an open position, in which it opens an opening of the receiving space, and a closed position, in which it closes the opening, wherein locking means are provided with at least one locking member which is movable between a locking position, in which it blocks a movement of the cover in the closed position, and an unlocking position, in which it unlocks the cover for movement, and wherein the locking means have at least one blocking element which is movable between a blocking position, in which it blocks a movement of the locking member from a locking position into an unlocking position, and an unblocking position, in which permits movement of the locking member between a locking position and an unlocking position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
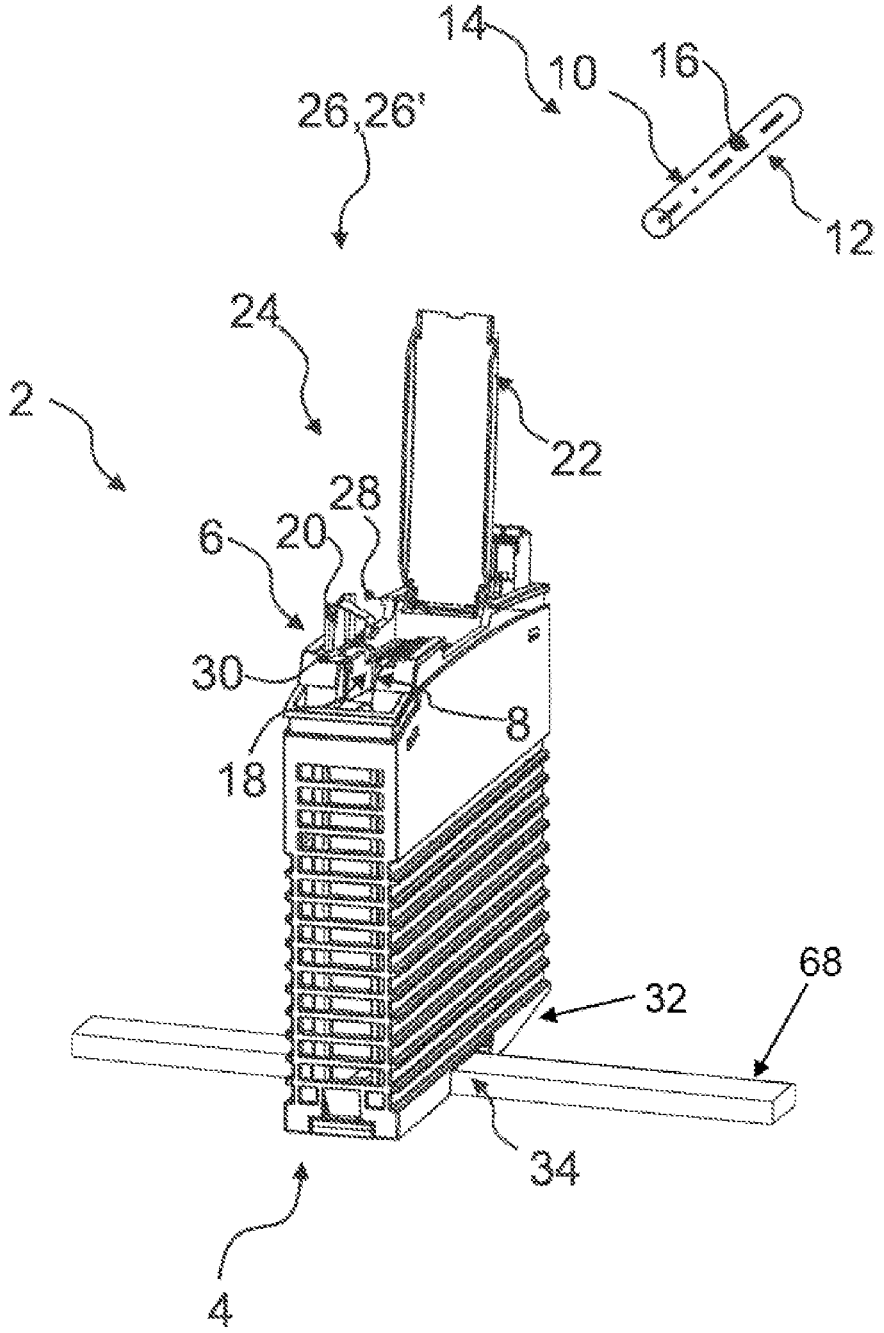
FIG. 1 a schematic illustration of an exemplary embodiment of an electronic device according to the invention in a perspective view, wherein the cover is in an open position and the housing cover is in a starting position, FIG. 2 the exemplary embodiment of an electronic device according to the invention from FIG. 1 in the same illustration as in FIG. 1, wherein an uninsulated shield conductor section of a cable is inserted in the connecting device and the cover is in a movement state from an open position into a closed position, FIG. 3 the exemplary embodiment of an electronic device according to the invention in the same illustration and view as in FIG. 1, wherein the cover is in a closed position and the housing cover is in an end position, FIG. 4 the exemplary embodiment of an electronic device according to the invention, wherein the illustration is focused on the connecting device and the arrangement of the housing cover on the housing body, in an otherwise identical illustration and view as in FIG. 1, wherein the cover is in an open position for inserting the uninsulated shield conductor section into the receiving space and, for this purpose, the housing cover is in a starting position, FIG. 5 the exemplary embodiment of an electronic device according to the invention in a view denoted by A in FIG. 4 in an otherwise identical illustration as in FIG. 4, wherein the cover is again in an open position for inserting the uninsulated shield conductor section and, for this purpose, the housing cover is in a starting position, FIG. 6 the exemplary embodiment of an electronic device according to the invention from FIG. 5 in the same illustration as in FIG. 5, wherein the cover is again in a closed position for contacting the uninsulated shield conductor section and, for this purpose, the housing cover is in an end position, FIG. 7 the exemplary embodiment of an electronic device according to the invention from FIG. 6 in the same illustration as in FIG. 6, but in a view denoted by B in FIG. 6, wherein the cover is again in a closed position for contacting the uninsulated shield conductor section and, for this purpose, the housing cover is in an end position, FIG. 8 the exemplary embodiment of an electronic device according to the invention in the same illustration and view as in FIG. 2, wherein the cover is in an open position and, for this purpose, the housing cover is in a starting position; in this case, the shield conductor section is inserted into the receiving space.

In an embodiment, the present invention provides an electronic device having a connecting device which allows secure contacting of the shield conductor with little handling effort.

In an embodiment, the present invention therefore provides a connecting device that has at least one cover which is arranged movably on the housing body between an open position, in which the cover opens an opening of the receiving space, and a closed position, in which the cover closes the opening.

Once the cover is in a closed position, the opening of the receiving space is closed such that the shield conductor section arranged therein is held in the receiving space and in particular cannot be removed from the receiving space via the opening.

The cover therefore likewise serves to securely hold the shield conductor section in the receiving space, as a result of which secure contacting of the shield conductor also takes place. For simple electrical contacting, the shield conductor section is free from insulation and is thus uninsulated. Within the scope of the invention, a shield conductor section therefore denotes in particular an uninsulated shield conductor section.

Furthermore, locking means are provided with at least one first locking member which is configured and designed such that it is movable between a locking position, in which it blocks a movement of the cover in the closed position, and an unlocking position, in which it unlocks the cover for movement between a locking position and an unlocking position. As a result, a first movement protection of the cover against undesired movement is realized.

Within the scope of the invention, it is provided in particular that the locking effect of the locking member on the cover is canceled by actuating the locking member, so that the locking effect can be released and also activated again. The activation preferably takes place automatically by the design of the locking member.

For further securing against undesired movement of the cover, the locking means of an electronics housing according to the invention have at least one blocking element which is configured and designed in such a way that it is movable between a blocking position, in which it blocks a movement of the locking member from a locking position into an unlocking position, and an unblocking position, in which it permits movement of the locking member between a locking position and an unlocking position.

The invention thus allows the double securing of the cover against any undesired movement from a closed position into an open position. This is brought about first by the locking member and also by the blocking element, which in turn secures the locking member in its locking position against undesired movement into an unlocking position and inhibits a corresponding movement.

Within the scope of the invention, a shield conductor is, for example and in particular, a component of a cable which serves to shield a conductor or a plurality of conductors arranged in the cable. Within the scope of the invention, a cable is to be understood in particular as a single-wire or multi-wire bundle of conductors, which bundle is provided with an electrically insulating sheathing and which conductors serve to transmit electrical energy or signals. In this case, the sheathing can also comprise a plurality of sheath layers, which surround the at least one conductor.

In order to be able to electrically contact a sheathed shield conductor by means of the connecting device of an electronic device according to the invention, the insulation must be removed at least at the relevant contacting point of the cable. The shield conductor is thus contacted via its preferably uninsulated shield conductor section, which can be or is inserted into the receiving space of the connecting device for this purpose.

With this as the background, the term "uninsulated" is to be understood within the scope of the invention to mean that at least the relevant shield conductor section for electrical contacting is free from insulation at least in sections.

Within the scope of the invention, the shield conductor is formed, for example and in particular, as a shield braid, which is arranged around the conductor (or the plurality of conductors) of the cable for electrically shielding it (them). The shield conductor can be formed, for example and in particular, by a shield braid consisting of a plurality of strands/wires/cores. The shield conductor preferably serves as a protective conductor or for potential compensation of devices, contacts, lines, electrical/electronic components, as well as protective lines, electrically connected thereto.

According to the invention, the electrical contacting of the shield conductor by means of the connecting device can be brought about in various ways. It is thus possible for contact means to be provided on an inner wall of the receiving space, which contact means contact the electrical shield conductor as soon as it or its shield conductor section is brought to rest against them, and electrically connect it to a component, in particular a printed circuit board, arranged in the housing body. It is also possible to produce an aforementioned electrical connection by means of the cover, which is configured and designed for an electrical connection between the conductor and the electrical component in the closed position of the cover.

The housing body of an electronic device according to the invention serves to house electrical/electronic components and, for this purpose, can be designed differently according to the invention and can therefore serve, for example and in particular, for housing one or a plurality of printed circuit board(s).

An advantageous development of the invention provides that the blocking element is movably coupled to the housing cover such that the blocking element is in the blocking position if the housing cover is in the end position, and the blocking element is in an unblocking position if the housing cover is in the starting position. The blocking element is thus actuated by actuating the housing cover. This eliminates the need for a separate actuation of the blocking element, as a result of which the simplified handling of the blocking element is achieved.

The movement coupling can be achieved according to the invention in a variety of ways, for example by coupling elements or a transmission.

In order to simplify production, a further advantageous development of the invention provides that the blocking element is held, in particular integrally formed, on the housing cover. Since the blocking element is integrally formed on the housing cover, the production of the blocking element is simplified, as a result of which advantages in the replacement part inventory are also achieved. Furthermore, an adaptation of the movement coupling can be omitted when changing the housing cover.

Within the scope of the invention, the housing cover can be arranged on the housing body by various bearing possibilities. It is thus possible to provide a translational or linear movement guide for the housing cover, in order to guide it movably between the starting position and an end position. However, a cost-effective and simple movement guide can be achieved in particular by the housing cover being mounted on the housing body so as to be pivotable about a pivot axis, as is provided in a further advantageous development of the invention. It is thus also possible in a simple manner to hold the housing cover captively on the housing body. The replacement of the housing cover is also possible in a simple manner.

Following this idea, a further advantageous development of the invention provides that the cover is mounted on the housing body so as to be pivotable about a pivot axis, whereby a change from an open position into a closed position (and vice versa) takes place by a pivoting movement of the cover about the pivot axis.

In order to prevent the pivoting movements of the housing cover and of the cover from being directed in the same direction, a further advantageous development of the invention provides that the pivot axis of the cover is arranged transversely to the pivot axis of the housing cover. As a result, it is possible to increase safety when the cover is held in the closed position.

The secure holding of the cover is possible in a simple and effective manner, in particular by holding the cover in its closed position in a positive-locking manner. For this purpose, a further advantageous development of the invention provides that the locking member is configured and designed for holding the cover in a positive-locking manner in its closed position, in order to hold it in this closed position and to block a movement into an open position.

For this purpose, a further advantageous development of the invention provides that the locking member has at least one latching element, which latches with the cover in the closed position and thus holds it in this position.

In order to enable a holding effect by means of small forces, the latching element is arranged in particular radially at a distance from the pivot axis of the cover. In this case, for latching, the latching element preferably interacts with a section of the cover which is spaced apart from the pivot axis, in particular arranged at a free end. The holding effect with which the locking member blocks a movement of the cover in the closed position is thus achieved in a positive-locking manner, whereby a corresponding implementation is simplified. The form fit can be brought about according to the invention by actuating the locking member.

Thus, the force with which the locking member causes a movement of the cover to be blocked can be kept small. Accordingly, the latching element can likewise be favorably dimensioned to reduce material and weight. Furthermore, an actuation of the locking member for releasing the locking effect on the cover in the closed position is thus simplified.

According to the invention, the locking member thus preferably acts on a section which is located at a free end of the cover or in its vicinity. Within the scope of the invention, the vicinity is characterized in that its distance from the pivot axis is greater than its distance from the free end of the cover.

The section is configured and designed for latching with the latching element so that the section is shaped, for example and in particular, at least in sections, in a manner complementary to the latching element.

In order to facilitate handling, a further advantageous development of the invention provides that the latching element is arranged on a spring arm, which has a free end which can be elastically deflected between a rest position and a deflection position in relation to a further end, with which it is arranged in a fixed manner on the housing body.

The spring element is in the rest position if its free end is undeflected in relation to the fixed end. It is accordingly in a deflection position if its free end is deflected in relation to the fixed end.

It is thus made possible according to the invention that an actuation of the spring arm brings about a deflection of its free end and that the locking effect of the locking member can thus be canceled. The locking effect on the cover is made possible by the automatic return movement into the rest position as soon as the spring arm is unloaded.

The latching element can be designed in various ways for latching with the cover. Within the scope of the invention, it is preferred that the latching element has at least one, in particular hook-shaped, projection which is configured and designed to latch on an outer side, in particular in a recess formed thereon or on a shoulder formed thereon, of the cover.

For a simple design and production, it is considered according to the invention that, for latching with the cover, the latching element at least in sections overlaps an outer surface of the cover facing away from the receiving space.

For this purpose, a further advantageous development of the invention provides that, for latching with the cover, the latching element at least in sections overlaps an edge of the cover.

For further simplification of the production and handling of an electronics housing according to the invention, a further advantageous development of the invention provides that the housing cover and/or the cover is/are formed in one piece.

The simplified accessibility of the connecting device for inserting or removing the uninsulated shield conductor section into the receiving space is achieved by a further advantageous development of the invention in that the connecting device is arranged on the housing body in such a way that the receiving space is arranged on an outer side of the housing body. It is thus accessible from outer side the housing body so that a further handling simplification of an electronics housing according to the invention results.

In a further advantageous development of the invention, a further securing of the cover in order to prevent undesired movement is provided in that the housing cover is configured and designed such that it at least in sections covers the cover in the end position. The housing cover thus inhibits a movement of the cover from the closed position into an open position. Furthermore, this results in the advantage that the connecting device is protected, for example, from environmental influences, such as dust, and from undesired actuation.

Electronic devices according to the invention are designed, for example and in particular, for equipping a switchgear cabinet and are preferably configured and designed for mounting or for latching onto a support rail, as is provided in a further advantageous development of the invention.

For latching onto a support rail, an electronics housing according to the invention has a latching device which is arranged on the housing body and engages behind the edges of the support rail for this purpose. The design of such a latching device is known and can be realized, for example, by means of hook bodies which are resiliently adjustable in relation to one another and are arranged on the housing body and engage behind the support rail edge in a latching manner when latching onto the support rail. Detaching is brought about, for example, by bending one of the hooks away from the support rail, whereupon the housing body can be detached from the support rail.

For the secure holding of the housing cover on the housing body, a further advantageous development of the invention provides that the housing cover is configured and designed in such a way that it is arrested in a positive-locking or force-fitting manner on the housing body in the end position. The invention thus makes it possible to securely hold the housing cover on the housing body, in order to prevent an undesired movement of the housing cover to leave the closed position.

For this purpose, a positive-locking arresting can be brought about, for example, by latching latching elements to one another which are designed and configured accordingly. This can be done, for example and in particular, in that they are designed to be complementary to one another at least in sections. Force-fitting holding can be realized in a simple manner by clamping, for example. To this end, the housing body is designed to interact with the housing body in this respect. The invention also includes a combination of the two aforementioned closing types.

This ensures that any undesired movement of the housing cover is prevented. The actuation of the housing cover for movement from the closed position into the open position preferably brings about a release of the arresting, so that a simple actuation is achieved according to the invention.

According to the invention, arresting means are provided, in order to arrest the housing cover in the end position in a positive-locking or force-fitting manner on the housing body.

The invention is explained in more detail below with reference to the attached drawing, in which an exemplary embodiment of an electronic device according to the invention is shown as a representative of a plurality of electronic devices according to the invention.

The figures in the drawing show a possible embodiment of an electronic device according to the invention in a schematic representation in each case. The illustrations in the figures are therefore in particular not necessarily to scale, so that the scales selected in each case in the figures may also differ from each other.

For greater clarity, the illustrations are reduced to the elements/components/constituent parts supporting an understanding, wherein the same or corresponding components/constituent parts or elements are provided with the same reference signs in the figures. For a better overview, all elements/components/constituent parts are not always provided with reference signs in the figures, wherein the assignment results from the same representation or a representation adapted to the view.

In the case of the same or a similar structure, the description is reduced below to the differences between the figures for a better overview.

The features illustrated on the basis of the figures also apply correspondingly or analogously comprehensively as well as in a manner isolated from each other to further electronic devices formed according to the invention. The invention is therefore not limited to the exemplary embodiments or combinations described and shown.

FIG. 1 shows an exemplary embodiment of an electronic device 2 according to the invention in a perspective view in a schematic illustration. The exemplary embodiment of an electronic device 2 according to the invention is also shortened and referred to below as electronic device 2.

The electronic device 2 has a housing body 4 for housing components. The component housed in the housing body 4 is a printed circuit board on which electrical components for signal or current processing are arranged, which are used to process currents and signals entering via input interfaces and to provide them to output interfaces for further use. Within the scope of the invention, the term "electrical components" or "components" also includes electronic components or parts.

Furthermore, the electronic device 2 is equipped with a connecting device 6 which is configured and designed for connecting the shield conductor 12 of a cable 14 (represented in FIG. 1 by the shield conductor section 10 shown). For this purpose, the connecting device 6 has a receiving space 8 for the shield conductor section 10 of the shield conductor 12, in which receiving space the shield conductor section 10 is to be inserted for the electrical contacting thereof.

The shield conductor 12 forms a sheath layer 16 of cable 14, which surrounds the other conductors of the cable 14. For this purpose, the shield conductor 12 is formed by a shield braid which consists of individual strands and which surrounds the conductors of the cable 14 in a tubular manner.

The shield braid is not shown in detail but is represented schematically by the sheath layer 16.

The aforementioned conductors as well as the shield conductor 12 are sheathed with an insulating layer which is formed from an insulating material and from which at least the shield conductor section 10 is free for electrically contacting the shield conductor 12. In this respect, the shield conductor section 10 is also referred to below as an uninsulated shield conductor section 10.

The cable 6 with its further conductors and the shield conductor 12 surrounding them are represented schematically in the figures by an uninsulated shield conductor section 10, which is free in sections from the insulating layer and serves for the electrical contacting of the shield conductor.

For the insertion and removal of the uninsulated shield conductor section 10 into/out of the receiving space 8 for the electrical contacting thereof by the connecting device 6, an opening 18 for the shield conductor 4 is provided and can be closed by a cover 20. Once the shield conductor section 10 is inserted into the receiving space 8 and the cover is in a closed position, the connecting device 6 contacts the shield conductor 12 via the shield conductor section 10.

For this purpose, the cover 20 is movably arranged on the housing body 4 between an open position, in which it opens an opening of the receiving space 8, and a closed position, in which it closes the opening.

In FIG. 1, the cover 20 is shown in an open position, so that the uninsulated shield conductor section 10 can be inserted into the receiving space 8 via the opening 18. The open position also makes it possible to remove the shield conductor section 10 inserted in the receiving space 8.

Furthermore, the electronic device 2 is provided with a housing cover 22 movable between a starting position and an end position for covering a housing body section 24, which is formed on an end face 26 of the housing body 4. The end face 26 is also an outer side 26' of the housing body 4.

The housing cover 22 is mounted on the housing body 4 so as to be pivotable about a pivot axis 28 (represented by a dash-dot line). In an alterative embodiment, housing cover 22 is mounted on housing body 4 so as to be linearly translational (i.e., in the direction of double-headed arrow 23 shown in FIG. 7) between the starting postion and the end position.

The cover 20 is also mounted on the housing body 4 so as to be pivotable about a further pivot axis 30, which is arranged transversely to the pivot axis 28 of the housing cover 22. In this exemplary embodiment, the pivot axis 28 of the housing cover 22 and the pivot axis 30 of the cover 20 are arranged orthogonally to one another.

Both the cover 20 and the housing cover 22 are each formed in one piece. The housing cover 22 is formed from a non-conductive material or insulating material and the cover 20 is formed from an electrically conductive material, so that the cover 20 also serves to contact the shield conductor 12 or its uninsulated shield conductor section 10, in order to connect it to the relevant printed circuit board and to thus be able to connect it electrically. In this exemplary embodiment, the cover 20 is formed by a stamped and bent part, in particular of a metal sheet, as a result of which it can be produced cost-effectively.

FIG. 1 shows that the connecting device 6 is arranged on the housing body 4 in such a way that the receiving space 8 is arranged on the same outer side 26' of the housing body 4, on which the housing cover 22 is arranged or mounted so as to be pivotable.

Furthermore, the receiving space 8 is arranged in the housing body section 24, which is covered in sections by the housing cover 22 in its end position.

In its end position, the housing cover 22 thus also covers the cover 20 and protects it from environmental influences or undesired actuation or touch/contacting.

FIG. 1 also shows that the housing body 4 is configured and designed for latching onto a support rail 68 and, for this purpose, has a corresponding base section 32 with a latching device 34, by means of which the housing body 4 is latched onto the support rail 68. The design of a latching device 34 for latching onto or detaching from the support rail 68 has been described at the outset and presents no difficulties to the person skilled in the art so that a more detailed explanation is dispensed with at this point.

In this exemplary embodiment, the housing body section 24/the end face 26 and the base section 32 are arranged opposite to each other on the housing body 4.

Figure 2:
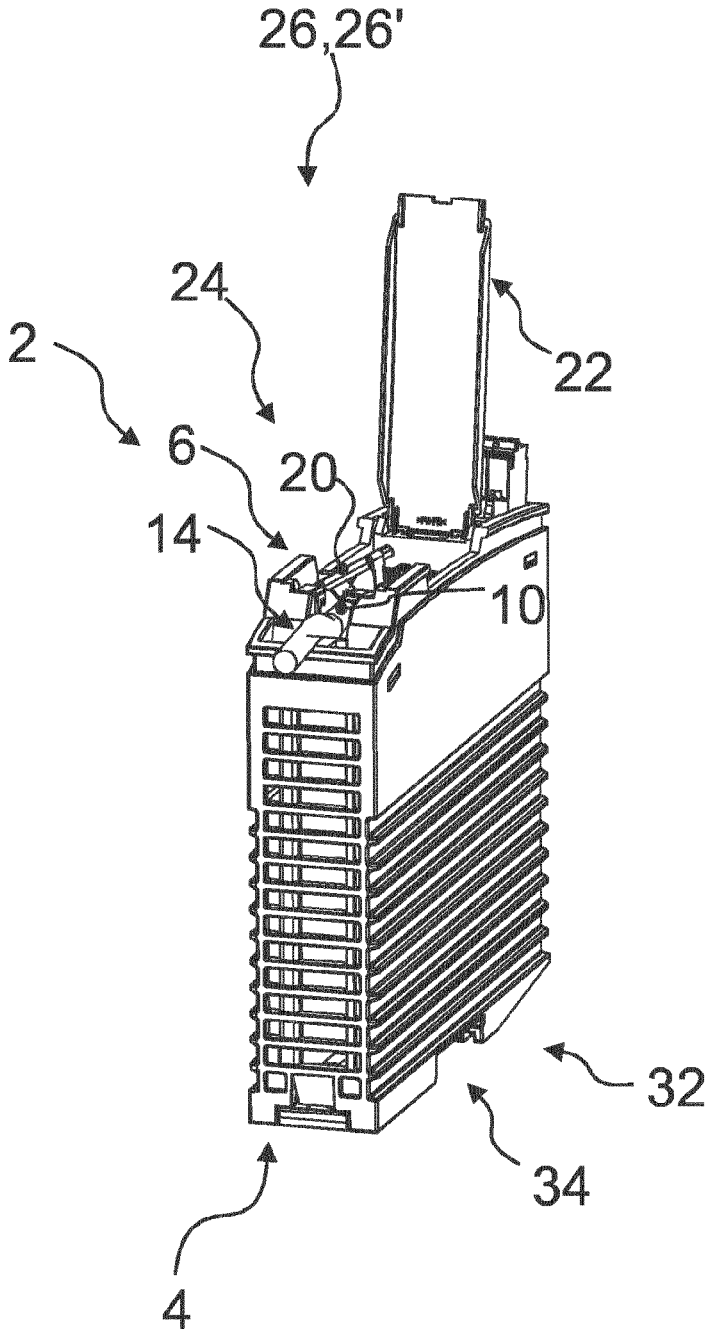
Figure 3:
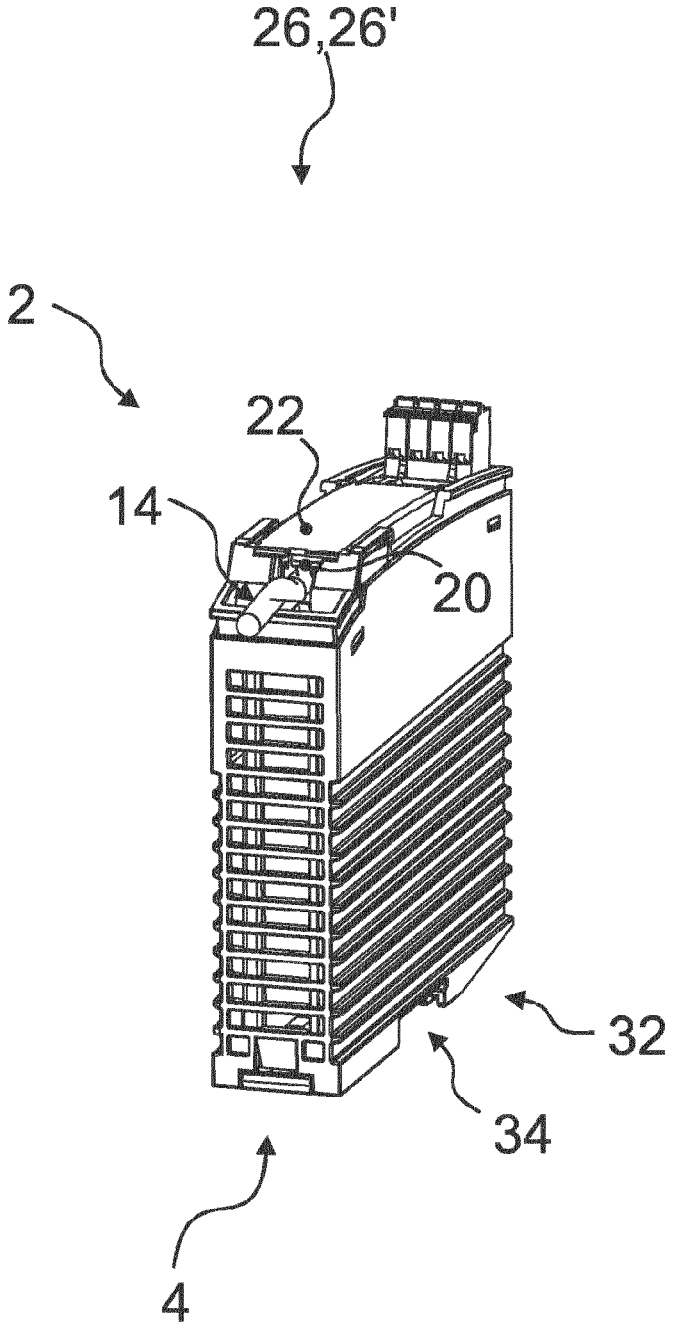

FIGS. 2 and 3 show the electronics housing 2 in various positions of the cover 20 or of the housing cover 22.

FIG. 2 shows the electronics housing 2, wherein the uninsulated shield conductor section 10 of the cable 14 is inserted in the connecting device 6 and the cover 20 is in a movement state from an open position into a closed position. In this case, the housing cover 22 is in the starting position, in which the housing cover 22 makes the housing body section 24 accessible. In FIG. 3, the cover 20 is in a closed position and the housing cover 22 is in an end position.

Figure 4:
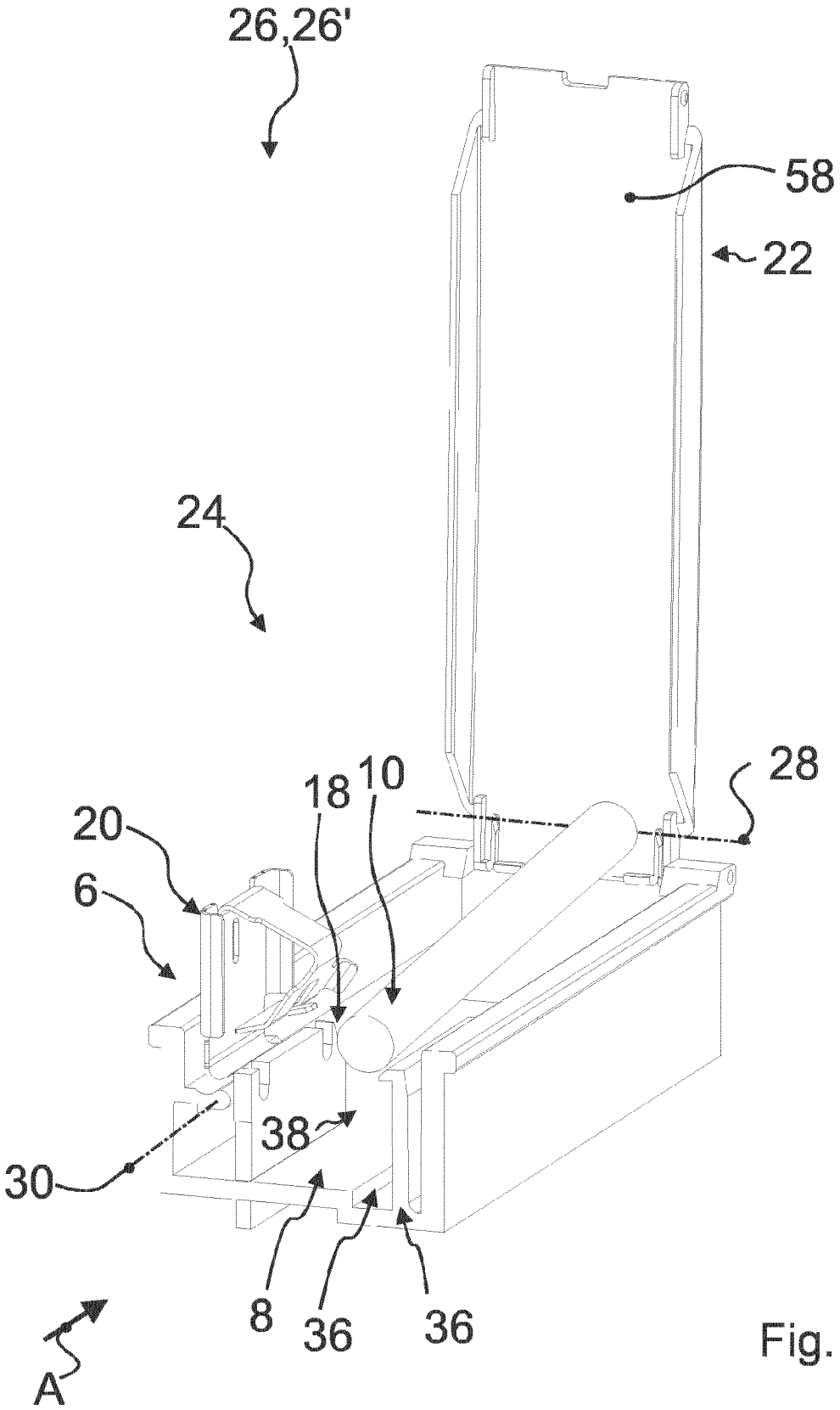

FIG. 4 shows the electronic device 2, wherein the cover 22 is in an open position for inserting the uninsulated shield conductor section 10 into the receiving space 8 and, for this purpose, the housing cover 22 is in a starting position so that the housing body section 24 with the connecting device 6 arranged therein is accessible for insertion of the uninsulated shield conductor section 10.

Figure 5:
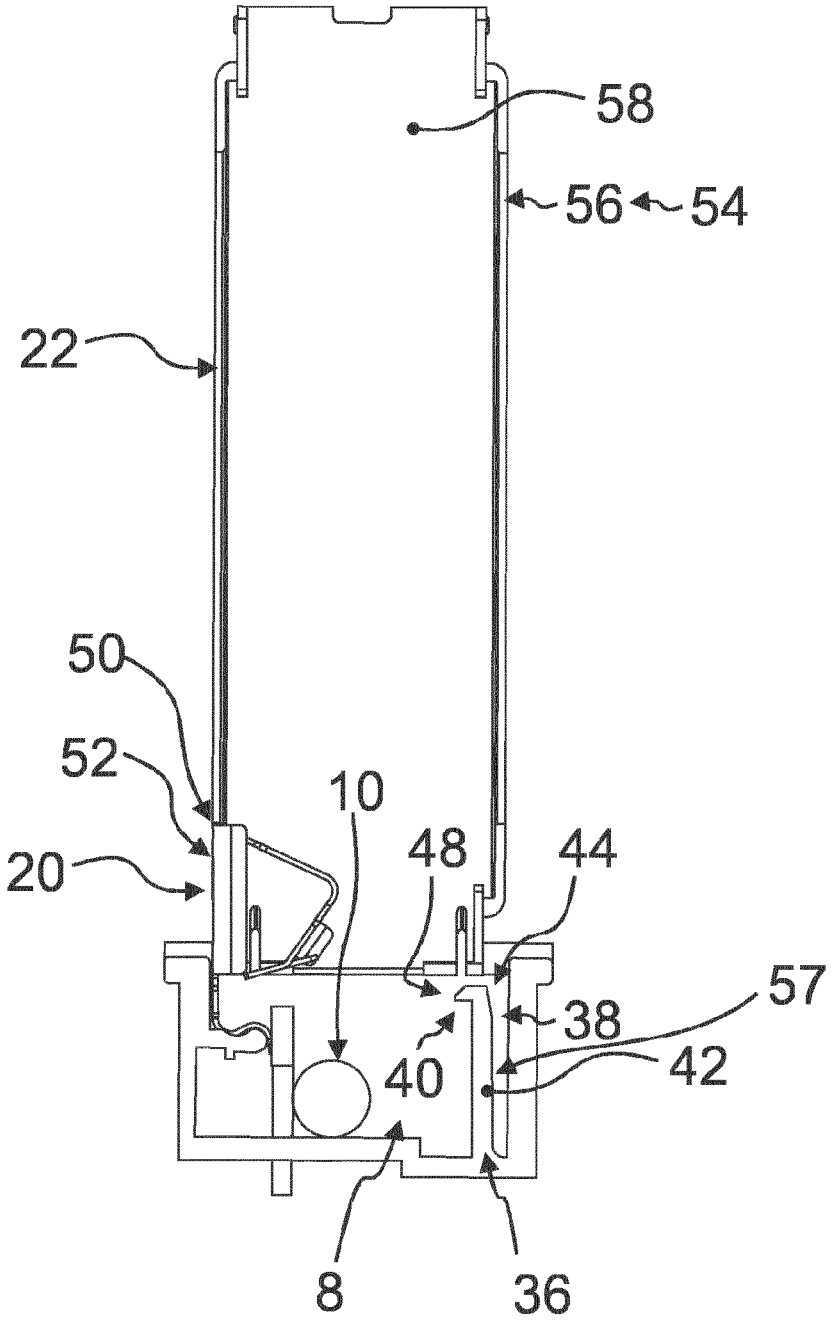

FIG. 5 shows the electronic device 2, wherein the cover 20 is again in an open position for insertion of the uninsulated shield conductor section 10 and, for this purpose, the housing cover 22 is in a starting position.

FIG. 5 illustrates that locking means 36 are provided in the electronic device 2 and have a locking member 38 which is movable between a locking position, in which it blocks a movement of the cover 20 in the closed position, and an unlocking position, in which it unlocks the cover 20 for movement, in particular for taking an open position.

In this case, the locking member 38 is configured and designed for a positive-locking holding of the cover 20 in the closed position.

For this purpose, the locking member 38 in this exemplary embodiment has a latching element 40, which latches with the cover 20 in the closed position. For this purpose, the latching element 40 is arranged on a spring arm 42, which has a free end 44 which can be elastically deflected between a rest position and a deflection position in relation to a further end 46 with which it is arranged in a fixed manner on the housing body 4, whereby a resilient deflection of the free end 44 in relation to the further end 46 of the spring arm 42 is brought about. The latching element 40 is arranged on the free end 44 of the spring arm 42, in order to enable simple latching between the latching element 40 and the cover 20. Within the scope of the invention, it is also possible to arrange the latching element 40 in the vicinity of the free end 44 of the spring arm 42. The vicinity is understood according to the invention to mean that the distance of the latching element 40 from the free end 44 of the spring arm 42 is less than the distance of the latching element 40 from the fixed end 46 of the spring arm.

The latching element 40 has a hook-shaped projection 48 which, for latching with the cover 20, overlaps an edge 50 of the cover 20 in sections. In this case, the hook-shaped projection 48 also overlaps in sections an outer side 52 of the cover 20 which faces away from the receiving space 8.

For securing the locking member 38 against movement, the locking means 36 have a blocking element 54 which is movable between a blocking position, in which it blocks a movement of the locking member 38 from a locking position into an unlocking position, and an unblocking position, in which permits movement of the locking member 38 between a locking position and an unlocking position.

In order to simplify the actuation of the blocking element 54, it is provided that the blocking element 54 is movably coupled to the housing cover 20 in such a way that the blocking element 54 is in the blocking position if the housing cover 22 is in the end position and the blocking element 54 is in an unblocking position if the housing cover 22 is in the starting position.

For this purpose, the blocking element 54 is integrally formed on the housing cover 22 and is thus an integral part of the housing cover 22.

In this exemplary embodiment, the blocking element 54 forms an edge section 56 of the housing cover 22 which, in the end position of the housing cover 22, the spring arm 42 is arranged on a side 57 facing away from the receiving space 8 such that prevents a deflection movement of the spring arm 42 for releasing the latching.

The edge section 54 is bent away from a cover section 58 and faces the housing body 4 in the end position of the housing cover 22.

Figure 6:
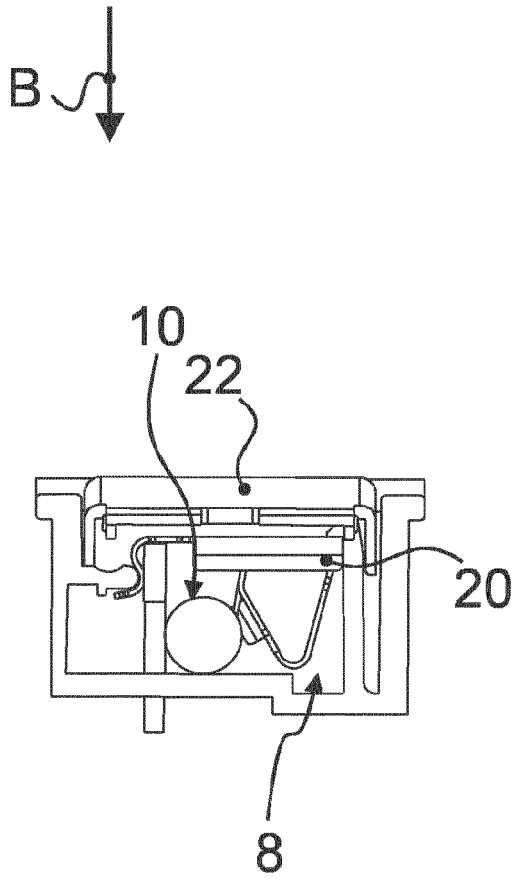
Figure 7:
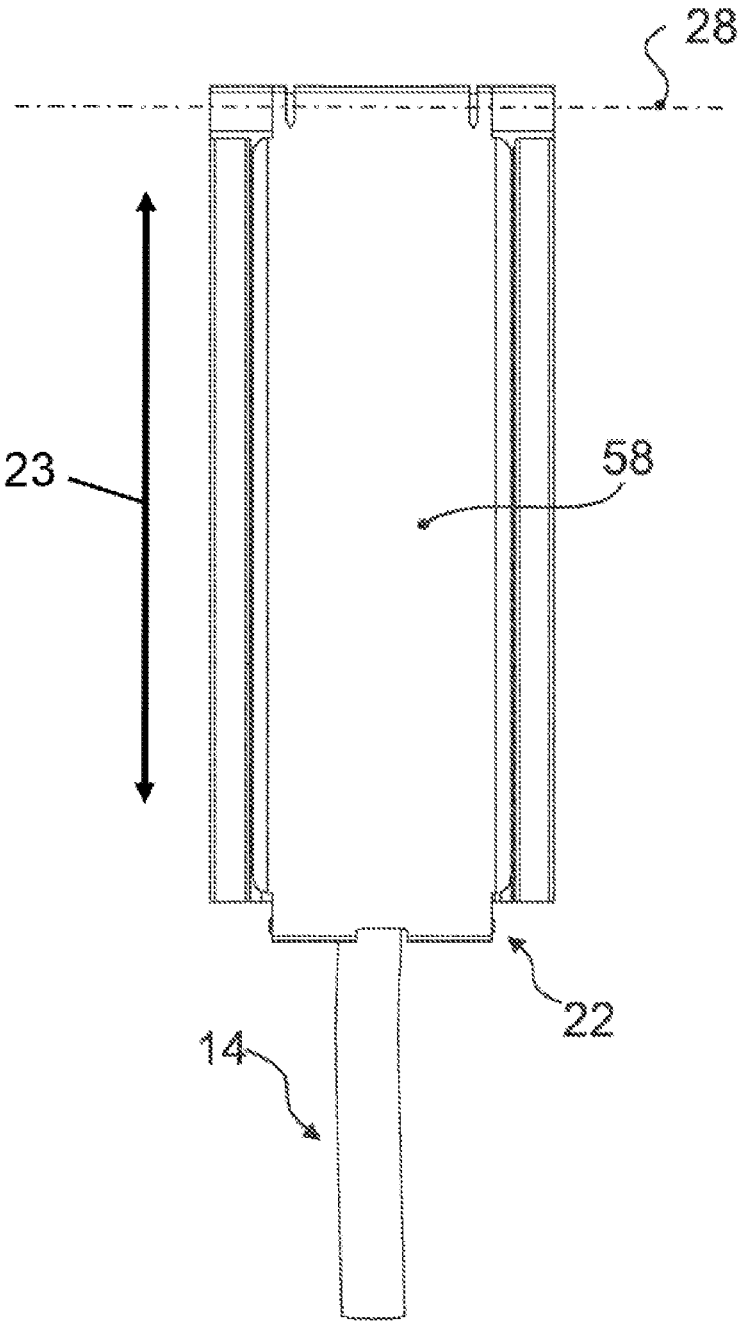

FIGS. 6 and 7 show the electronics housing 2 in each case in a view differing from FIG. 3. In FIG. 6, the cover 20 is again in the closed position for contacting the uninsulated shield conductor section 10 and the housing cover 22 is in the end position, in which the housing cover 22 covers the housing body section 24. FIG. 7 shows the electronic device 2 in a further view with respect to FIG. 6 for clarification of the end position in which the housing cover 22 is shown in FIG. 6.

Figure 8:
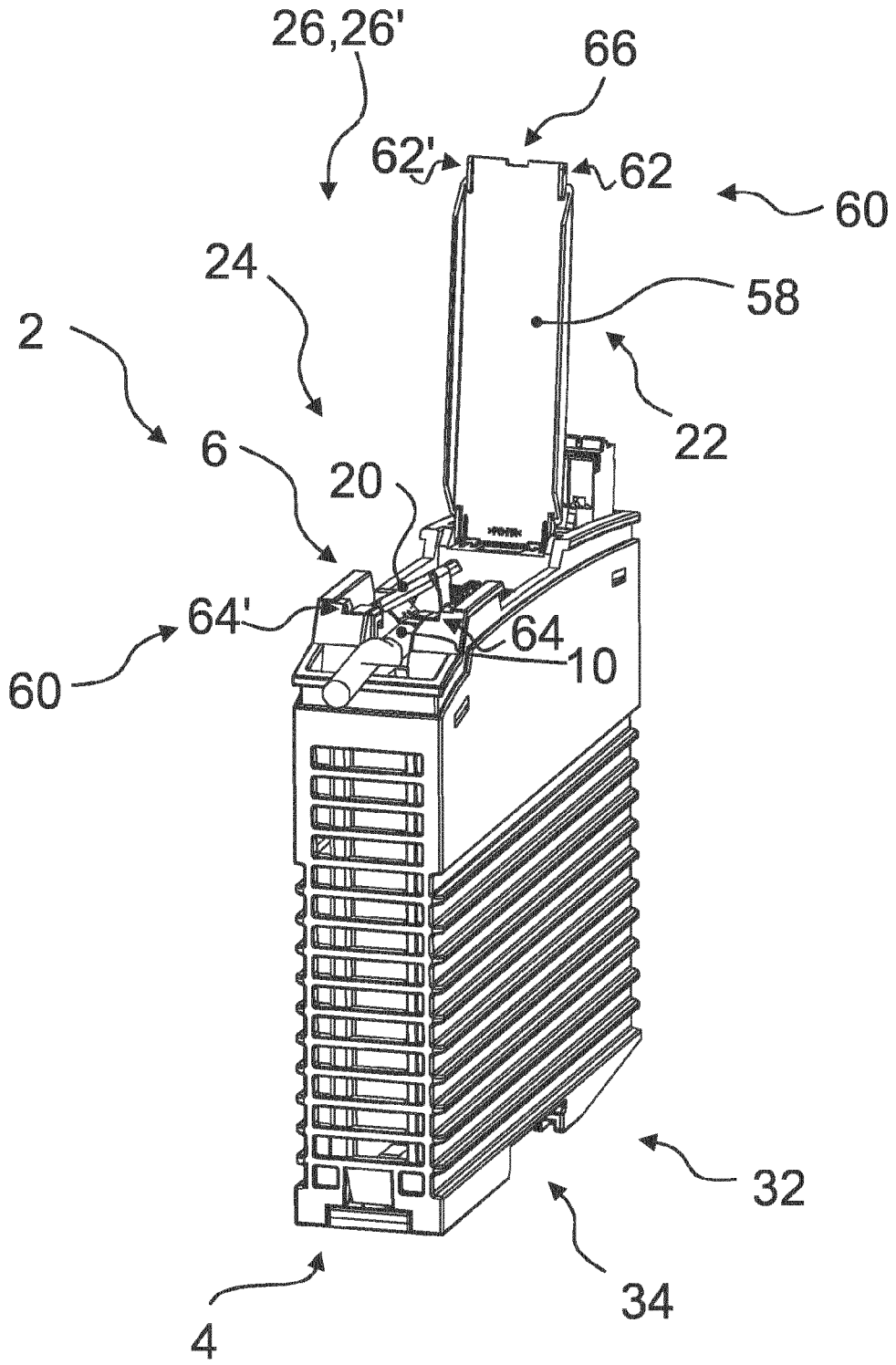

FIG. 8 shows the electronic device 2 analogously to FIG. 2, wherein the shield conductor section 10 is inserted into the receiving space 8.

In order to secure the housing cover 22 against undesired movement into a starting position, the housing cover in this exemplary embodiment is held in its end position in a positive-locking manner. An undesired automatic movement for taking the starting position is thus prevented.

Arresting means 60 are used for this purpose, which in turn have latching elements 62, 62', 64, 64', which interact in pairs with one another. For this purpose, one latching element 62, 62' of each latching element pair 62, 64; 62', 64' is arranged on the free end 66 of the housing cover 22 and the other latching element 64, 64' of the respective latching element pair 62, 64; 62', 64' is arranged on the housing body 4. On the basis of the view selected in FIG. 6, the latching elements 62', 64 are concealed but identically designed and arranged like the latching elements 62, 64' so that the relevant reference signs denote the latching elements 62', 64 symbolically in FIG. 8.

The latching elements 62, 62', 64, 64' of the respective latching element pair 62, 64; 62', 64' are designed so as to be complementary to one another for latching so that they latch with each other in the end position of the housing cover 22, wherein the actuation of the housing cover 22 for moving the housing cover 22 into the starting position causes the latching elements 62, 64; 62', 64' of the respective latching element pair 62, 64; 62', 64' to disengage from one another.

Within the scope of the invention, the latching elements 62, 62', 64, 64' can be designed in different ways so that the latching element pairs 62, 64; 62', 64 can also be designed differently from one another.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

| | |
|---|---|
| Electronic device | 2 |
| Housing body | 4 |
| Connecting device | 6 |
| Receiving space | 8 |
| Shield conductor section | 10 |
| Shield conductor | 12 |
| Cable | 14 |
| Sheath layer | 16 |
| Opening | 18 |
| Cover | 20 |
| Housing cover | 22 |
| Arrow | 23 |
| Housing cover section | 24 |
| End face | 26 |
| Outer side | 26' |
| Pivot axis (of housing cover 22) | 28 |
| Pivot axis (of cover 20) | 30 |
| Base section | 32 |
| Latching device | 34 |
| Locking means | 36 |
| Locking member | 38 |
| Latching element | 40 |
| Spring arm | 42 |
| Free end (of spring arm 42) | 44 |
| Further end (of spring arm 42) | 46 |
| Hook-shaped projection | 48 |
| Edge (of cover 20) | 50 |
| Outer side of (of cover 20) | 52 |
| Blocking element | 54 |
| Edge section (of housing cover 22) | 56 |
| Facing-away side (of spring arm 42) | 57 |
| Cover section | 58 |
| Arresting means | 60 |
| Latching element | 62, 62', 64, 64' |
| Free end (of housing cover 22) | 66 |

The invention claimed is:

1. An electronic device, comprising:

a housing body for housing components, comprising a connecting device which has a receiving space for a shield conductor section; and a housing cover movable between a starting position and an end position for covering a housing body section, wherein the connecting device has at least one cover which is configured so as to be movably arranged on the housing body between an open position, in which it opens an opening of the receiving space, and a closed position, in which it closes the opening, wherein locking means are provided with at least one locking member which is movable between a locking position, in which it blocks a movement of the cover in the closed position, and an unlocking position, in which it unlocks the cover for movement, wherein the locking means have at least one blocking element which is movable between a blocking position, in which it blocks a movement of the locking member from a locking position into an unlocking position, and an unblocking position, in which permits movement of the locking member between a locking position and an unlocking position, wherein the housing cover is mounted on the housing body so as to be pivotable about a pivot axis, and wherein a pivot axis of the cover is arranged transversely to the pivot axis of the housing cover.

2. The electronic device according to claim 1, wherein the blocking element is movably coupled to the housing cover such that the blocking element is in the blocking position if the housing cover is in the end position and the blocking element is in the unblocking position if the housing cover is in the starting position.

3. The electronic device according to claim 1, wherein the blocking element is held so as to be integrally formed on the housing cover.

4. The electronic device according to claim 1, wherein the cover is mounted on the housing body so as to be pivotable about a pivot axis.

5. The electronic device according to claim 1, wherein the housing cover and/or the cover are formed in one piece in each case.

6. The electronic device according to claim 1, wherein the connecting device is arranged on the housing body such that the receiving space is arranged on an outer side of the housing body.

7. The electronic device according to claim 1, wherein the housing cover in the end position covers the cover at least in sections.

8. The electronic device according to claim 1, wherein the housing body is configured to latch onto a support rail.

9. The electronic device according to claim 1, wherein the housing cover is configured to be arrested in the end position on the housing body in a positive-locking or force-fitting manner.

10. The electronic device according to claim 1, wherein the locking member is configured to hold the cover in the closed position in a positive-locking manner.

11. The electronic device according to claim 10, wherein the latching element has at least one hook-shaped projection configured to latch on an outer side of the cover in a recess formed thereon or on a shoulder formed thereon of the cover.

12. The electronic device according to claim 1, wherein the locking member has at least one latching element configured to latch with the cover in the closed position.

13. The electronic device according to claim 12, wherein the latching element is arranged on a spring arm which has a free end which is elastically deflectable between a rest position and a deflection position in relation to a further end with which it is arranged in a fixed manner on the housing body.

14. The electronic device according to claim 12, wherein the latching element at least in sections overlaps an edge of the cover for latching with the cover.

15. An electronic device, comprising:

a housing body for housing components, comprising a connecting device which has a receiving space for a shield conductor section; and a housing cover movable between a starting position and an end position for covering a housing body section, wherein the connecting device has at least one cover which is configured so as to be movably arranged on the housing body between an open position, in which it opens an opening of the receiving space, and a closed position, in which it closes the opening, wherein locking means are provided with at least one locking member which is movable between a locking position, in which it blocks a movement of the cover in the closed position, and an unlocking position, in which it unlocks the cover for movement, wherein the locking means have at least one blocking element which is movable between a blocking position, in which it blocks a movement of the locking member from a locking position into an unlocking position, and an unblocking position, in which permits movement of the locking member between a locking position and an unlocking position wherein the locking member has at least one latching element to hold the cover in the closed position in a positive-locking manner, and wherein the latching element has at least one hook-shaped projection configured to latch on an outer side of the cover in a recess formed thereon or on a shoulder formed thereon of the cover.

16. An electronic device, comprising:

a housing body for housing components, comprising a connecting device which has a receiving space for a shield conductor section; and a housing cover movable between a starting position and an end position for covering a housing body section, wherein the connecting device has at least one cover which is configured so as to be movably arranged on the housing body between an open position, in which it opens an opening of the receiving space, and a closed position, in which it closes the opening, wherein locking means are provided with at least one locking member which is movable between a locking position, in which it blocks a movement of the cover in the closed position, and an unlocking position, in which it unlocks the cover for movement, wherein the locking means have at least one blocking element which is movable between a blocking position, in which it blocks a movement of the locking member from a locking position into an unlocking position, and an unblocking position, in which permits movement of the locking member between a locking position and an unlocking position, wherein the locking member has at least one latching element configured to latch with the cover in the closed position, and wherein the latching element at least in sections overlaps an edge of the cover for latching with the cover.

17. An electronic device, comprising:

a housing body for housing components, comprising a connecting device which has a receiving space for a shield conductor section; and a housing cover movable between a starting position and an end position for covering a housing body section, wherein the connecting device has at least one cover which is configured so as to be movably arranged on the housing body between an open position, in which it opens an opening of the receiving space, and a closed position, in which it closes the opening, wherein locking means are provided with at least one locking member which is movable between a locking position, in which it blocks a movement of the cover in the closed position, and an unlocking position, in which it unlocks the cover for movement, wherein the locking means have at least one blocking element which is movable between a blocking position, in which it blocks a movement of the locking member from a locking position into an unlocking position, and an unblocking position, in which permits movement of the locking member between a locking position and an unlocking position, and wherein the housing cover is mounted on the housing body so as to be linearly translational between the starting position and the end position.

* * * * *